United States Patent [19]

Ball

[11] Patent Number: 4,831,791

[45] Date of Patent: May 23, 1989

[54] SPACE DIVIDER SYSTEM

[75] Inventor: Douglas C. Ball, Quebec, Canada

[73] Assignee: Hauserman, Inc., Cleveland, Ohio

[21] Appl. No.: 673,512

[22] Filed: Nov. 20, 1984

[51] Int. Cl.[4] ..... A47B 5/00

[52] U.S. Cl. ..... 52/36; 160/135; 160/351

[58] Field of Search ..... 52/239, 243, 71, 36; 160/351, 352, 135

[56] References Cited

U.S. PATENT DOCUMENTS

| | | | |
|---|---|---|---|
| 3,762,116 | 10/1973 | Anderson et al. | 160/135 X |
| 3,895,670 | 7/1975 | Bales et al. | 160/351 X |
| 4,224,769 | 9/1980 | Ball et al. | 52/36 |

*Primary Examiner*—David A. Scherbel
*Assistant Examiner*—Creighton Smith
*Attorney, Agent, or Firm*—Renner, Otto, Boisselle & Sklar

[57] ABSTRACT

A space divider system utilizes horizontally extending beams mounted on height adjustable legs. The system includes main beams on which are two enclosed wire raceways at substantially work surface height. Also included are stabilizer beams which may be attached at their inner ends to any point along the main beam between the legs. The outer ends of the stabilizer beams are connected to a relatively short transverse beam which includes height adjustable posts or legs at each end. The outer end of the stabilizer beam may optionally be connected to the center of the transverse beam or to either leg or to a leg alone to form a T, I or L-shape configuration. The stabilizer beam and transverse beam have the same configuration and may support work surfaces or other components. Work surface such as table tops may also be supported from the legs at the ends of the transverse beams. The stabilizer beam is at a lower elevation than the main beam and when cantilever tops are employed the space between the tops above the beam may be provided with wire management trays. Also, posts may project upwardly from the stabilizer beam in turn supporting rails so that sound and visual pads may extend upwardly, and that upper components may also be supported.

13 Claims, 4 Drawing Sheets

SPACE DIVIDER SYSTEM

DISCLOSURE

This invention relates generally as indicated to a space divider system and more particularly to certain improvements in a space divider system of the type shown and described in applicant's copending application Ser. No. 081,437 filed Oct. 3, 1979 entitled "Space Divider System".

BACKGROUND OF THE INVENTION

In such prior U.S. patent application there is disclosed a versatile space dividing system which is manufactured and marketed by SunarHauserman of Cleveland, Ohio under the trademark RACE.

The system comprises a series of beams mounted on height adjustable legs. The beams may be connected to the legs at 45' increments and some beams are provided with a midpoint specially designed connection which may optionally be used. Further such beams include two enclosed wire raceways on the top thereof which is substantially at work surface height. Furniture and other components may be supported from the beam by mounting brackets at substantially any point therealong. However, a beam itself can only be connected to a specially engineered midpoint connection of another beam.

Also, one of the more common items of furniture utilized with the system is known as a bullet top or work surface which is supported at its inner end in cantilever fashion from the beam and its outer end on a single leg or pedestal. For larger work surfaces such as larger desks or conference tables, additional support is desirable.

SUMMARY OF THE INVENTION

With applicant's present invention the highly acclaimed and successful RACE space divider system is provided with even greater flexibility and utility.

More particularly there is provided a space divider system utilizing horizontally extending main beams mounted on height adjustable legs and stabilizer beams which may be attached readily at their inner ends to any point along the main beam between the legs. The top of the main beam is provided with two enclosed wire raceways at substantially work surface height.

The outer ends of the stabilizer beams are connected to a relatively short transverse beam which includes height adjustable posts or legs at each end. The outer end of the stabilizer beam may optionally be connected to the center of the transverse beam or to either leg or to a leg alone to form a T, I or L-shape configuration. The stabilizer beam and transverse beam have the same configuration and may support work surfaces or other components. Work surfaces such as table tops may also be supported from the posts or legs at the ends of the transverse beams. Stabilizer beams may also be connected to each other by essentially the same connecting system to form essentially limitless work surface supporting configuration, either attached to the main beam at a selected location or free standing.

The stabilizer beam is at a lower elevation than the main beam and when cantilever tops are employed the space between the tops above the beam may be provided with wire management trays. Also, posts may project upwardly from the stabilizer beam in turn supporting rails so that sound and visual pads or panels may extend upwardly, and that upper components may also be supported above the stabilizer beams.

In addition, there is provided a more simplified leg both for the main and stabilizer beams which readily permits the assembly of the beams thereto and which may more easily be height adjusted. Such legs are also more sturdy and easier to manufacture and assemble Other objects and advantages of the present invention will become apparent as the following description proceeds.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
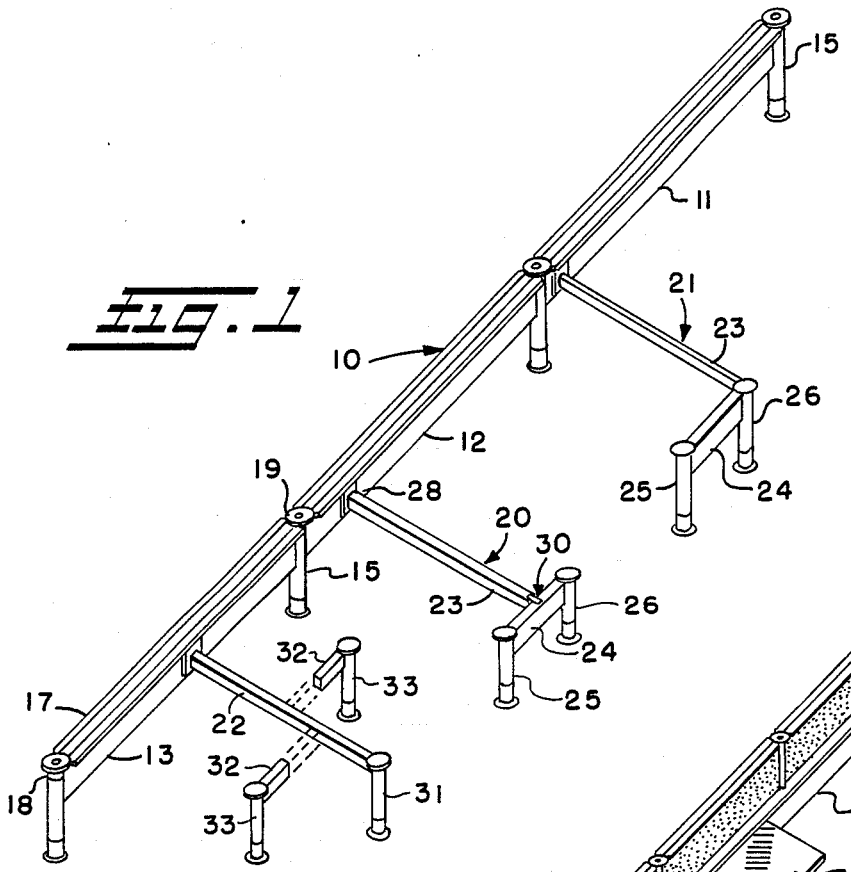
FIG. 1 is a schematic isometric partially exploded illustration of a main beam and stabilizer beams extending therefrom, one stabilizer beam being connected to a leg of the transverse beam or frame while another is connected to the midpoint of the beam.

Referring first to FIG. 1, there is illustrated a main beam of the space divider system seen generally at 10. The main beam comprises three sections 11, 12 and 13 which are supported between the four height adjustable legs indicated at 15. The top of the main beam is provided with two superjacent wiring raceways seen generally at 17 and 18, the upper raceway being laterally enlarged and designed for communication wiring. Both raceways extend through the legs by means of special cap sections indicated at 19. The beams may support a variety of work tops, hanging components or other items either from the beam itself or from its superstructure and such beams may be interconnected in a wide variety of layouts. Reference may be had to applicant's aforementioned copending application for a disclosure of the versatility of the space divider system.

As seen in FIG. 1, there extends laterally from main beam system 10 two stabilizer beams indicated generally at 20, 21 and 22. In the example illustrated, each stabilizer beam 20 and 21 comprises a longitudinal beam 23, and a relatively short transverse beam 24 interconnecting two height adjustable legs 25 and 26. The inner end of the longitudinal beam is connected as indicated at 28 to the main beam by a special clamp attachment hereinafter described which permits the inner end of the stabilizer beam to be connected to any point along the main beam structure between the legs 15. The outer end of the longitudinal beam 23 is connected to the midpoint of the transverse beam 24 as indicated at 30.

The stabilizer beam 21 has identical components. However, it will be noted that the longitudinal beam 23 is connected to the top of leg 26 rather than to the midpoint of the short transverse end beam 24.

The stabilizer beam 22 is connected only to a single height adjustable leg 31 at its outer end forming an I configuration and may optionally be provided with one or more transverse half beams 32 each including a single height adjustable leg 33. The half beams may be connected to the beam 22 in the same manner as the connection 30 hereinafter described.

The relatively simple form of the space divider system seen in FIG. 1 creates a self-supporting and easily leveled and made plumb system without requiring extensive right angle main beam connections or without requiring laterally projecting feet at the bottom of the main beam legs.

Figure 2:
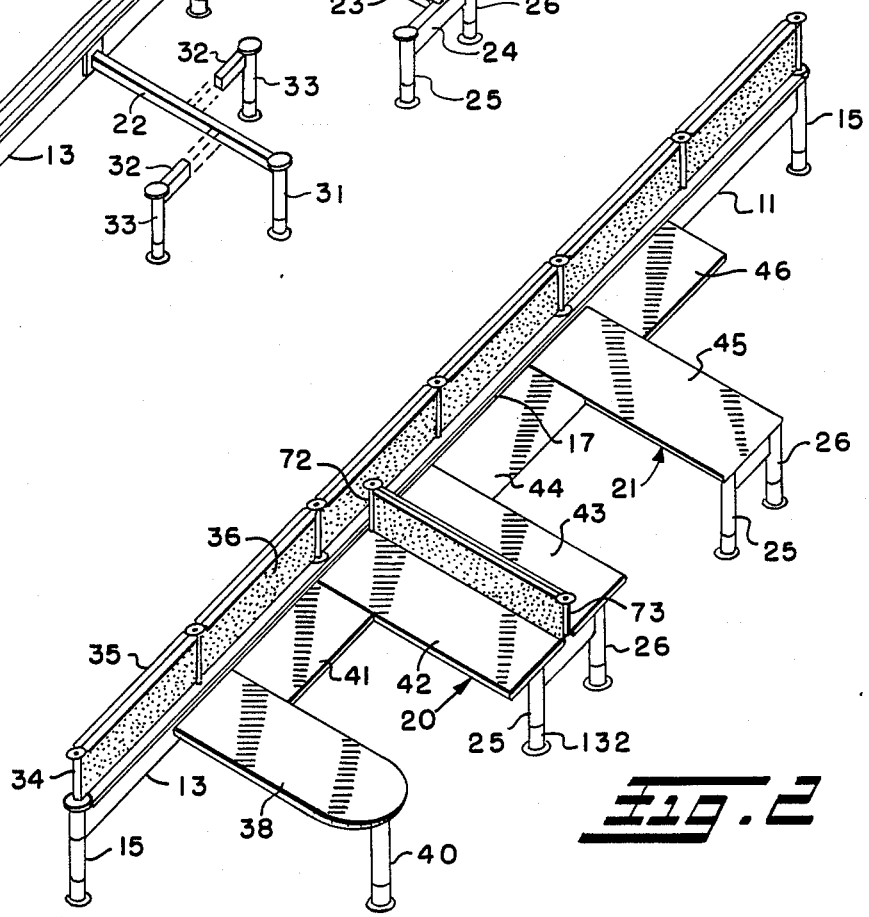
FIG. 2 is a view similar to FIG. 1 illustrating additional items such as, pads, screens, work surfaces and the like supported both fro the main beam and the stabilizer beams.

Referring now to FIG. 2 there is illustrated the same space dividing system of FIG. 1 but with certain components added to the system. It will be appreciated that the components illustrated are strictly by way of example and that a variety of other components may be used additionally or in lieu of those illustrated. Such components may be attached to the main beam system in essentially the same manner as illustrated in applicant's noted copending application and may be attached to and supported from the stabilizer beam systems in the manner more clearly hereinafter described.

As illustrated, the main beam may have a superstructure which includes a series of upwardly extending tubular posts 34 which are interconnected at one or more elevations by horizontally extending T-rails 35. Such posts and rails create a reticulate superstructure framework which may accomodate fabric covered pads 36 which act as sound absorbing pads and also as visual barriers. The superstructure may also support ambient lighting, or hanging components. In addition the posts may extend to the ceiling providing wiring access to one or the other of the raceways on top of the main beam at essentially work surface height.

Reading from bottom to top in FIG. 2, there is illustrated a bullet-nose work top 38 supported from the beam 13 and also supported by a single leg 40 at the outer end thereof. The next adjacent work surface indicated at 41 is a relatively short work surface supported in cantilever fashion from the main beam. The work surface 41 acts as a filler between the work surface 38 and work surface 42 which is supported in cantilever fashion from the stabilizer beam 20. The left hand side of the work surface 42 may, of course, also be supported in cantilever fashion from the main beam. On the opposite side of the stabilizer beam assembly 20 is a further work surface 43 which may be supported in the same fashion but on the opposite side of the main longitudinal beam 23 of the stabilizer beam assembly 20. Next there appears a surface 44 which may be the same as work surface 41 which provides an end bridge between the work surface 43 and the rather substantial work surface 45 supported on the stabilizer beam assembly 21. The work surface 45 may also be supported in cantilever fashion from the main beam assembly. It will be appreciated that the longitudinal beam 23 of the stabilizer beam assembly 21 is aligned with the leg 26 or the upper edge of the work surface. This clears the entire undersurface of the work top on the other side or for the hanging of deep components such as the drawer file systems Finally, there is provided a work surface 46 which is generally similar to the work surfaces 41 and 44 As the following description proceeds, it will be appreciated that many more components and variations may be utilized.

Figure 5:
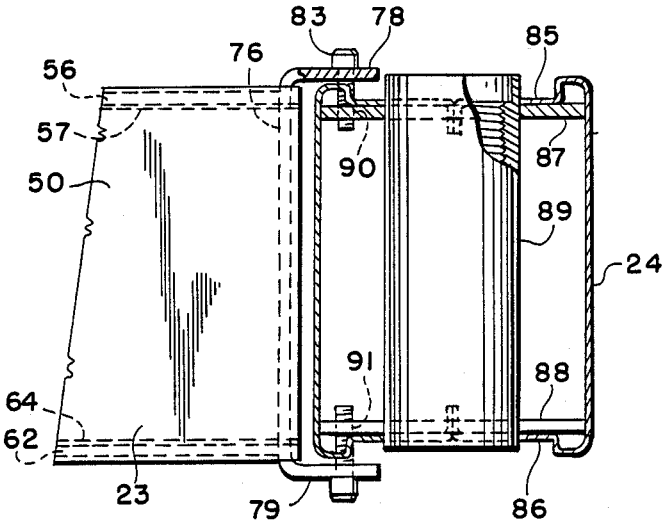
FIG. 5 is a further enlarged vertical section taken from the line 5—5 FIG. 3.
Figure 6:
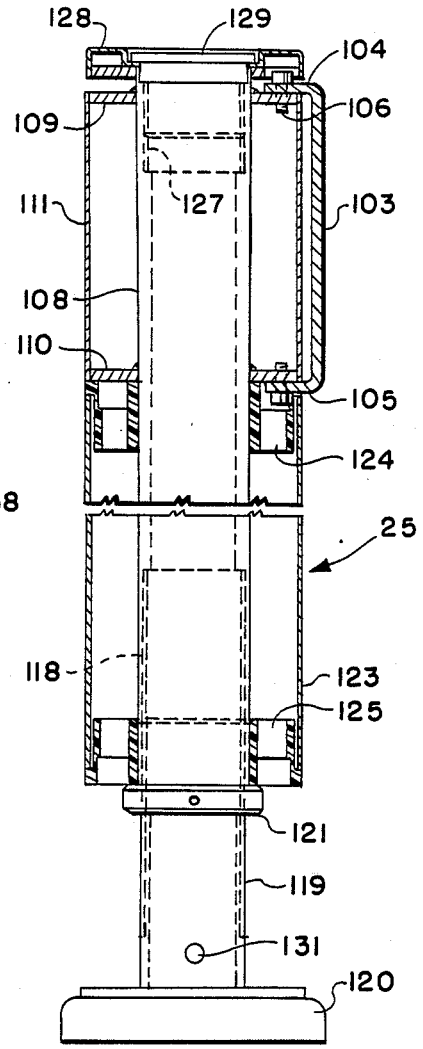
FIG. 6 is a section of the stabilizer beam leg as seen, for, from the line 6—6 of FIG. 3.
Figure 7:
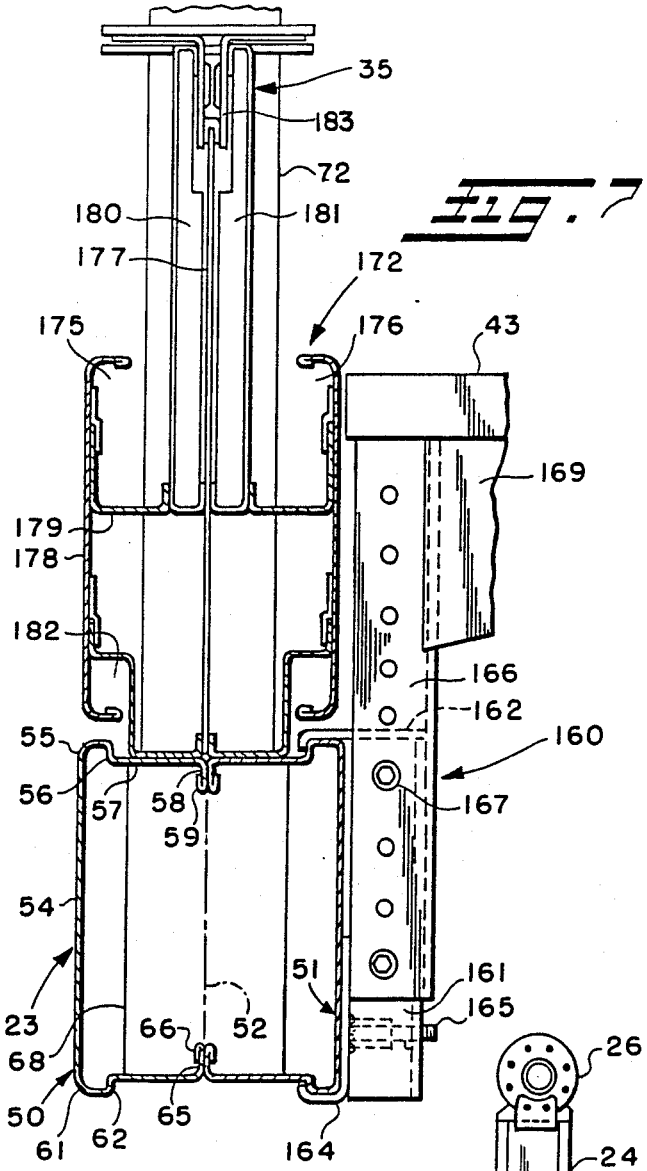
FIG. 7 is a fragmentary vertical section taken through the stabilizer beam illustrating the manner in which a work surface may be cantilevered therefrom and also illustrating the wire management trays which may be positioned on top of the stabilizer beam; and, FIG. 8 is a top plan view of an example of a free-standing table or work surface frame which may be constructed with the components of the present invention.

Turning now to FIGS. 3–7, and initially to FIG. 7, it will be seen that the longitudinal beam 23 of the stabilizer assembly comprises primarily two half parts 50 and 51 which are secured together along the vertical center line of the beam. The half parts are a mirror image of each other and accordingly, only the part 50 will be described in detail. The sheet metal part 50 includes an outer vertical wall 54 which at its top rounded corner 55 extends inwardly a relatively short distance and then downwardly as indicated at 56 an even shorter distance and horizontally inwardly as seen at 57. At the center line, the beam cover or face extends downwardly to form a short vertical flange 58 which is seamed as indicated at 59.

The bottom configuration is the same with a lower rounded corner extending inwardly a short distance to an upturned edge 62 which extends then horizontally inwardly to form the wall 64 which terminates in upturned flange 65 and the seamed edge 66. It will be appreciated that in addition interior gussets or bracing sections may be employed, not shown. In any event, the two halves of the beam may be secured together along the vertical edge flanges to form an essentially enclosed box beam which has in the center a recessed top and bottom wall. As indicated in FIG. 3, the top and bottom walls may be interconnected by tubular sockets seen at 68 and 69, in which tubular vertical posts may be inserted, such posts being seen at 72 and 73 in FIG. 2 and being the same as the post 34.

Figure 3:
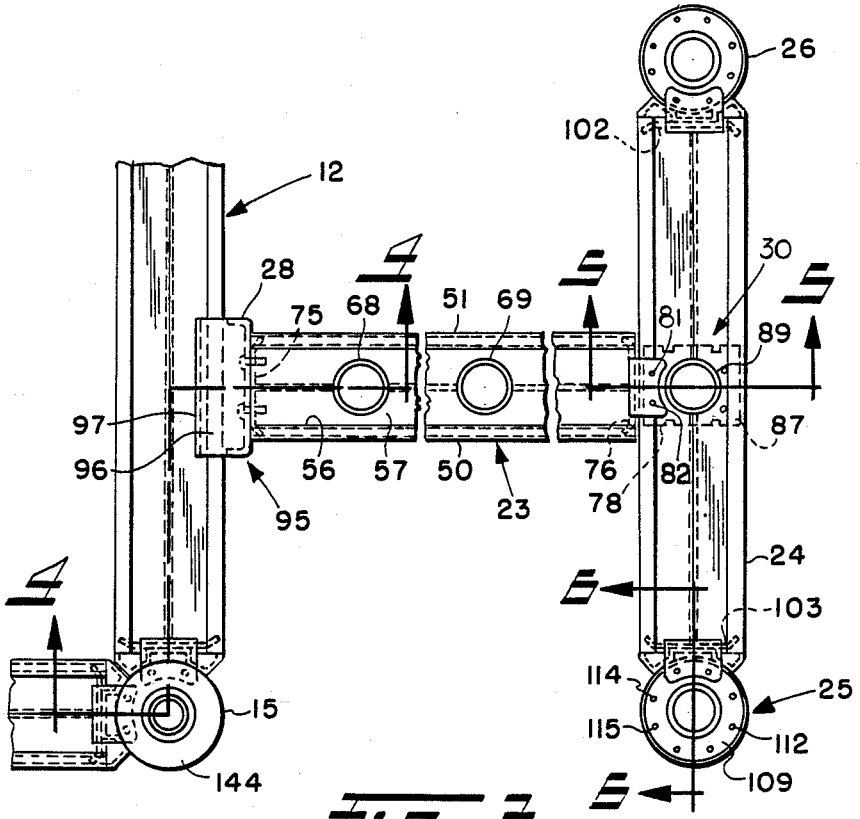
FIG. 3 is a fragementary top plan view with the main beam system on the left and a stabilizer beam connected thereto.

As seen more clearly in FIG. 3, the ends of the beam 23 are closed by plates 75 at the inner end and 76 at the outer end. Such plates are .relatively thick and the plate at the outer end is provided with two horizontal ears at the top and bottom seen more clearly at 78 and 79 in FIG. 5. Each ear is provided with two holes seen at 81 and 82 adapted to accomodate fasteners 83 by which the end of the beam may be secured either to the center of the transverse beam 24 or to either leg 25 or 26.

As seen in FIGS. 3 and 5 the relatively short transverse beam 24 has the same sectional configuration as the longitudinal beam 23 The beam is formed of two halves on each vertical side of the same configuration which when secured together form a box beam having top and bottom walls which are recessed along the length of the beam. Such walls are seen at 85 and 86 in FIG. 5.

At the center of the beam to provide the connection 30 the joined flanges of the box sections are cut away and the underside of the top wall 85 of bottom wall 86 is provided with a mounting plate 87 while the top side of bottom wall 86 is provided with a mounting plate 88. The mounting plates are interconnected by tubular socket 89. Each side of each mounting plate is provided with spaced tapped holes as seen at 90 and 91 to accomodate the fasteners 83 so that the end of the beam 23 may readily be secured to the transverse beam 24.

Figure 4:
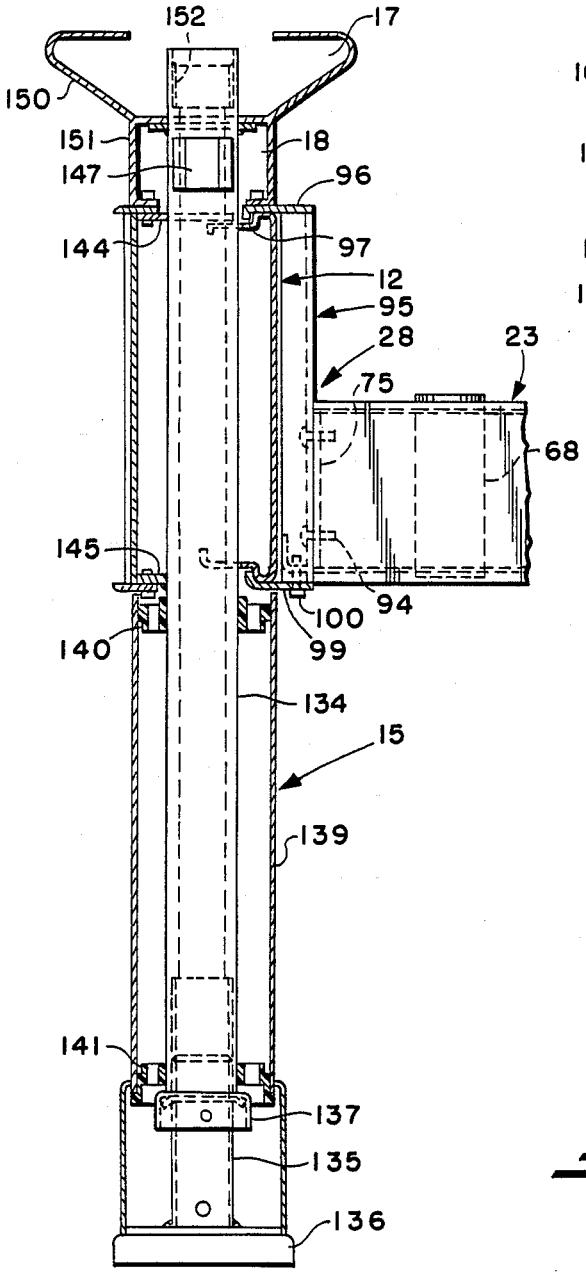
FIG. 4 is a enlarged vertical section taken substantially line 4'4 of FIG. 3.

As seen more clearly in FIGS. 3 and 4, the plate 75 closing the inner end of the longitudinal beam 23 has secured thereto by fasteners 94 a C-shape bracket 95, the top of which includes a relatively wide hook 96 which includes a downturned flange 97 adapted to be positioned behind the recessed portion of the top of the main beam 12. The bottom of C-shape bracket includes a removable hook 99 which may be secured to the bottom of the bracket by one or more fasteners 100 The hook portions of the bracket may be provided with interior plastic pads or linings to insure both tight clamping pressure and a mar or scratch-free engagement with the main beam.

Turning now to FIGS. 3 and 6, it will be seen that the ends of the transverse beams 24 are provided with closure plates 102 and 103 which are identical to the closure plate 76 on the outer end of the longitudinal beam 23. Such closure plates include top and bottom horizontal tabs 104 and 105 accomodating fasteners 106 so that the transverse beam may be secured to the legs 25 and 26 in exactly the same manner as the longitudinal beam is secured to the midpoint connection 30

As indicated in FIG. 6, the leg 25 comprises a main tubular element 108 to which is secured upper and lower disks 109 and 110, the exterior of which is connected by housing 111. As indicated more clearly in FIG. 3, each disk is provided with eight equally circumferentially spaced tapped holes 112, the spacing of any two of which is the same as the spacing of the tapped holes 90 or 91 in the plates 87 or 88 at the center connection 30. In this manner, the longitudinal beam 23 may equally well be connected to either post as for example, at the tapped holes 114 and 115 seen in FIG. 3.

The lower end of the interior tubular portion of the tube 108 is internally threaded as indicated at 118 to receive threaded jack screw 119 which is mounted for rotational movement on plastic glide 120 A lock nut is provided on the jack screw as indicated at 121 and by tightening the lock nut against the bottom of the tube 108, the leg may be locked in vertically adjusted position. The lower end of the leg is provided with a cover 123 which is mounted on plastic guides or sleeve bearings 124 and 125 so that the cover may be readily moved upwardly and downwardly, the latter depending upon the position of lock nut 121.

The upper end of the tubular interior column 108 of the leg is internally threaded as seen at 127 so that a tubular post such as 72 may be threaded thereinto. The top of the leg may be provided with a readily removable appearance cap 128 and the top of the tubular threaded socket may be provided with a plug 129 when not in use.

It may now be seen that either the short transverse beam or the longitudinal beam may readily be connected to the leg and that the height of the leg may readily be adjusted Since both the appearance cap 128 may be removed and the cover 123 may be moved downwardly, access to the fasteners 106 is easily provided. The height of the post may readily be adjusted simply by rotating the screw column 119 and a transverse hole is provided for that purpose as seen at 131. A suitable sliding appearance cover may be provided for the bottom of the post 25 as seen in FIG. 2

The post 15 for the main beam structure is of similar construction but somewhat taller. As seen in FIG. 4, the post 15 comprises an interior tubular column 134 supported on jack screw 135 at the bottom which may be rotated on glide 136. A lock nut 137 maintains the column in height adjusted position when tightened against the bottom of the tubular column 134 The lower end of the column is provided with an appearance housing 139 which may be moved vertically on plastic guides 140 and 141.

Secured to the inner column are vertically spaced disks 144 and 145 in the same manner as the disks for the leg seen in FIG. 6. However, such disks are substantially further vertically spaced. Such disks support in the same manner the main beam sections of the space divider system to which the C-bracket 95 attaches It is noted that the main beam sections are approximately twice the height of the stabilizer beam.

Above the disks the interior column 134 is provided with a window or opening 147 which communicates with the wiring raceway 18. The superimposed raceways 17 and 18 on top of the main beam system at essentially work surface height are formed by the configuration shown at 150 and 151, such configurations being at the leg formed in angular increments. The top of the interior column is provided with a threaded socket seen at 152 to accomodate the posts 34 or extensions thereof. As seen in FIG. 3, the legs 15 and the disks 144 and 145 with the eight equally circumferentially spaced tapped holes accomodate the main beams to extend at any 45° angle increment from the posts 15.

Referring now to FIG. 7, there is illustrated the longitudinal beam 23 of the stabilizer beam assembly and a special bracket 160 which may be secured thereto by which work tops such as shown at 43 may be cantilevered therefrom. Such special brackets include a post 161 having a top hook portion 162 which may hook to the top of the beam 23 in the same manner as the C-bracket 95 which hooks to the top of the main beam as seen in FIG. 4. The post includes a bottom J-shape hook and bearing plate 164 the hook portion of which hooks to the bottom of the beam as illustrated but which may be horizontally adjusted with respect to the post by means of the screw attachment 165 so that the plumbness of the post and thus the horizontal condition of the work surface 43 may be controlled. The height adjustment of the work surface is provided by a telescoping outer member 166 which may be fastened at various locations along the post by fasteners 167. The work surface 43 extends outwardly from the height adjustable sections and is supported through gussets or other similar supports 16*g*. .

When work surfaces are supported in cantilever fashion as indicated in FIG. 7 to extend on each side of the longitudinal beam 23, there is provided a space above the beam and between the work surfaces which may be filled by a wire management tray seen generally at 172. If posts 72 are employed extending from the sockets 68, the wire management trays may be positioned therebetween and held thereby. The wire management tray may include upper trays 175 and 176 on each side of a center septum 177, such trays being formed by the inwardly turned and rounded upper end of outer plate 178 and tray 179 secured thereto. Also, an enclosed lower tray may be provided secured to the outer plate in the same manner and forming a clevis for the bottom of the septum 177. One of these lower trays is indicated generally at 182. The lower edge of the outer plate may be inturned and seamed also as indicated to form a symmetrical top and bottom.

As indicated, the posts 72 may extend upwardly from the longitudinal beam 23 being fastened in sockets 68 through threaded connections such as those shown at the top of the legs.

On each side of the septum there may be provided a panel seen at 180 and 181 in the form of a fabric covered core. Such core may be wood or other composition. The panel frictionally engages the horizontal rail flange and the top of the septum is positioned between the vertical flanges by a resilient clip or seal 183 to prevent rattling. In any event, with the cantilever surfaces extending from the beam 23 at elevated heights which is the same height as the cantilever surfaces extending from the main beam, there is provided wire management trays which may be simply in the form of a dump for excess wiring at the back of the surface or which may be somewhat enclosed as the lower wire managing tray.

It will also be appreciated that other components such as storage units may be hung in similar fashion from the beam 23, and or from the transverse shorter beam 24.

Figure 8:
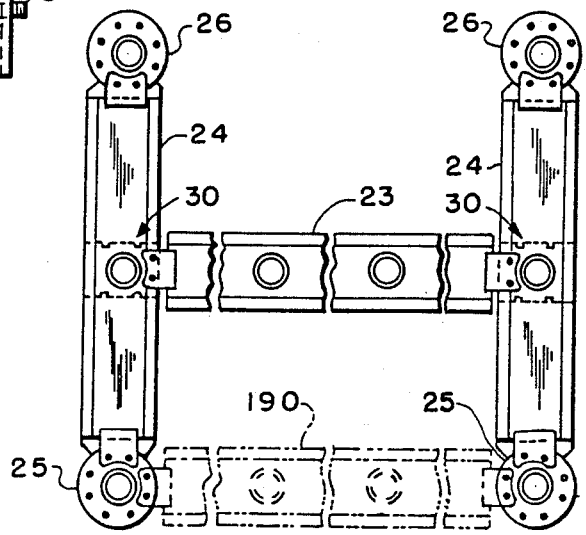

While the components of the present invention are primarily designed for connection to a main beam at any point along the main beam between supporting posts, it will be readily appreciated that the components may form free standing table or work surface supports. One such configuration is shown in FIG. 8. The configuration may be what is termed as an H-shape configuration. In such configuration the longitudinal beam 23 is connected to a midpoint 30 of two transverse beams 24 at each end, such transverse beams being supported on legs 25 and 26 at each of their ends. Alternatively, as-shown by the dotted line position 190 of the longitudinal beam, it will be appreciated that the longitudinal beam may be connected to the opposite legs 25 to form a shallow U-shape configuration work top supporting frame. Also, because of the ability to connect the beams to the legs at 45° increments, the legs of the U may be spread.

It will also be appreciated that the longitudinal beams 23 may be provided with center connections identical to that shown at 30 and that essentially limitless longitudinal transverse, etc. connections may be made to provide an extremely wide variety of table or work top supporting configurations. In supporting work tops or tables in the ree standing condition, as in connection with the condition shown by the work top 45, at least at the outer end of the stabilizer assembly, such work tops may be supported through sockets either in the legs or in the beams. Such supports may take the form of jack screws threaded into the tops of the sockets and then secured to the underside of the work surface or tops. Such supports may also take the form of simple plastic projections which simply fit into the tops of the sockets with the work surface or top being supported by gravity. Pin lock means may be provided if desired.

I claim:

1. A space divider system including a beam, legs at each end of said beam supporting the top of said beam at or below work surface height, each leg including a tubular interior column, vertically spaced upper and lower disks on said column, a housing on said interior column beneath said lower disk, means to move said housing on said column to provide access to the underside of said lower disk, said beam including horizontally projecting tabs on the end thereof, said tabs being adapted to fit closely over and under said disks, and fastener means to secure said tabs to said disks.

2. A space divider system as set forth in claim 1 including wire raceways on top of said beam, and enclosed passage means through said legs on the outside of said interior column connected to said raceways.

3. A space divider system as set forth in claim 2 including a window in said interior column communicating with one of said raceways.

4. A space divider system as set forth in claim 1 including jack means at the bottom of said interior column for height adjusting said legs.

5. A space divider system as set forth in claim 4 wherein said jack means is a rotatable screw, and lock means to hold said screw in adjusted position.

6. A space divider system including a beam, said beam having at least one leg at one of its ends supporting said beam, said leg including a tubular interior column, vertically spaced upper and lower disks on said column, a housing on said interior column beneath said lower disk, means to move said housing on said column to provide access to the underside of said lower disk, said beam including horizontally projecting tabs at the end thereof, said tabs being adapted to fit closely over and under said disks, and fastener means to secure said tabs to said disks.

7. A space divider system as set forth in claim 6 wherein said beam comprises a main beam of a space divider system.

8. A space divider system as set forth in claim 6 wherein said beam comprises a stabilizer beam of a space divider system.

9. A space divider system as set forth in claim 6 wherein said beam comprises a transverse beam of a space divider system.

10. A space divider system as set forth in claim 6 including raceways on top of said beam, and enclosed passage means through said legs on the outside of said interior column connected to said raceways.

11. A space divider system as set forth in claim 10 including a window in said interior column communicating with one of said raceways.

12. A space divider system as set forth in claim 6 including jack means at the bottom of said interior column for height adjusting said legs.

13. A space divider system as set forth in claim 12 wherein said jack means is a rotatable screw, and lock means to hold said screw in adjusted position.

* * * * *